US011183785B2

(12) United States Patent
Cha et al.

(10) Patent No.: US 11,183,785 B2
(45) Date of Patent: Nov. 23, 2021

(54) BOARD MATING CONNECTOR

(71) Applicant: GigaLane Co., Ltd., Hwaseong-si (KR)

(72) Inventors: Sun Hwa Cha, Hwaseong-si (KR); Hwa Yoon Song, Hwaseong-si (KR); Kyung Hun Jung, Hwaseong-si (KR); Hee seok Jung, Hwaseong-si (KR)

(73) Assignee: GIGALANE CO., LTD., Hwaseong-si (KR)

( * ) Notice: Subject to any disclaimer, the term of this patent is extended or adjusted under 35 U.S.C. 154(b) by 0 days.

(21) Appl. No.: 16/905,985

(22) Filed: Jun. 19, 2020

(65) Prior Publication Data

US 2021/0028567 A1 Jan. 28, 2021

(30) Foreign Application Priority Data

Jul. 26, 2019 (KR) ..... 10-2019-0091197

(51) Int. Cl.
*H01R 12/70* (2011.01)
*H01R 12/71* (2011.01)
*H01R 13/627* (2006.01)

(52) U.S. Cl.
CPC ..... *H01R 12/718* (2013.01); *H01R 12/714* (2013.01); *H01R 13/627* (2013.01)

(58) Field of Classification Search
CPC .. H01R 12/718; H01R 12/714; H01R 12/627; H01R 12/716; H01R 12/712; H01R 12/71; H01R 12/70; H01R 13/627; H01R 13/62
USPC ..... 439/345
See application file for complete search history.

(56) References Cited

U.S. PATENT DOCUMENTS 5,980,290 A * 11/1999 Meynier ..... H01R 13/6315 439/246
6,231,352 B1 5/2001 Gonzales
6,497,579 B1 * 12/2002 Garbini ..... H01R 13/6315 439/63
6,758,680 B2 * 7/2004 Duquerroy ..... H01R 24/50 439/63

(Continued)

FOREIGN PATENT DOCUMENTS

CN 101420091 B 11/2011
CN 110323608 A 10/2019

(Continued)

*Primary Examiner* — Harshad C Patel
(74) *Attorney, Agent, or Firm* — Brundidge & Stanger, P.C.

(57) ABSTRACT

A board mating connector includes a signal contact unit, a first ground portion including a hollow portion formed thereinside to accommodate at least a portion of the signal contact unit, a second ground portion including a hollow portion formed thereinside to accommodate at least a portion of the signal contact unit and at least a portion of the first ground portion, and an elastic member disposed between the first ground portion and the second ground portion to provide an elastic restoring force in a first direction. The first ground portion includes a first protrusion protruding outward or inward from a lower end portion thereof, and the second ground portion includes a second protrusion protruding from an upper end portion thereof in a direction different from that of the first protrusion. The first protrusion is engaged with the second protrusion in the hollow portion of the second ground portion.

10 Claims, 10 Drawing Sheets

(56) References Cited

U.S. PATENT DOCUMENTS

| | | | | |
|---|---|---|---|---|
| 6,776,668 | B1 * | 8/2004 | Scyoc | H01R 13/2421 439/295 |
| 7,416,418 | B2 | 8/2008 | Berthet | |
| 9,590,345 | B2 * | 3/2017 | Wollitzer | H01R 13/17 |
| 10,622,765 | B2 * | 4/2020 | Song | H01R 13/17 |
| 10,804,635 | B2 * | 10/2020 | Song | H01R 24/50 |
| 2003/0060069 | A1 * | 3/2003 | Duquerroy | H01R 24/50 439/188 |
| 2009/0149086 | A1 * | 6/2009 | Dahms | H01R 13/6315 439/835 |

FOREIGN PATENT DOCUMENTS

| | | | |
|---|---|---|---|
| CN | 109980384 | B | 8/2020 |
| KR | 101926503 | B1 | 12/2018 |
| KR | 101926504 | B1 | 12/2018 |
| KR | 1020190060662 | A | 6/2019 |
| KR | 102006134 | B1 | 8/2019 |
| WO | 2008120856 | A1 | 10/2008 |
| WO | 2019074310 | A1 | 4/2019 |

* cited by examiner

BOARD MATING CONNECTOR

CROSS-REFERENCE TO RELATED APPLICATION

This application claims the benefit under 35 U.S.C. § 119 of a Korean patent application No. 10-2019-0091197 filed on Jul. 26, 2019 in the Korean Intellectual Property Office, the entire disclosure of which is hereby incorporated herein by reference.

TECHNICAL FIELD

The present disclosure relates to a board mating connector, and more particularly, to a board mating connector capable of preventing the separation of a connector component.

BACKGROUND

Board mating connectors refer to connectors capable of performing an electrical connection between a pair of boards in a state in which an operator cannot directly see portions which are to be actually coupled between the pair of boards, such as printed circuit boards, on which signal lines are formed. To this end, even when there is an error in coupling positions of electronic components, in general, the connector is vertically and horizontally operated to enable coupling.

When an external force more than necessary is applied to the connector, internal components may be detached beyond an operating range due to the external force. When the detached components of the connector do not return to the original positions thereof, there may be a problem in that the connector does not normally operate. In this case, the connector cannot perform the original function of the connector that couples electronic components and forms an electrical connection.

SUMMARY

Technical Problem

The present disclosure is directed to providing a board mating connector capable of preventing the separation of a connector component and capable of preventing the deviation of an elastic member from the original position thereof.

Technical Solution

One aspect of the present disclosure provides a board mating connector including a signal contact unit, a first ground portion including a hollow portion formed thereinside to accommodate at least a portion of the signal contact unit, a second ground portion including a hollow portion formed thereinside to accommodate at least a portion of the signal contact unit and at least a portion of the first ground portion, and an elastic member disposed between the first ground portion and the second ground portion to provide an elastic restoring force in a first direction. The first ground portion of the board mating connector may include a first protrusion protruding outward from a lower end portion thereof, and the second ground portion of the board mating connector may include a second protrusion protruding inward from an upper end portion thereof. The first protrusion may be engaged with the second protrusion in the hollow portion of the second ground portion.

One aspect of the present disclosure provides a board mating connector including a signal contact unit, a first ground portion including a hollow portion formed thereinside to accommodate at least a portion of the signal contact unit, a second ground portion including a hollow portion formed thereinside to accommodate at least a portion of the signal contact unit, wherein at least a portion of the second ground portion is accommodated in the hollow portion of the first ground portion, and an elastic member disposed between the first ground portion and the second ground portion to provide an elastic restoring force in a first direction. The first ground portion of the board mating connector may include a first protrusion protruding inward from a lower end portion thereof, and the second ground portion of the board mating connector may include a second protrusion protruding outward from an upper end portion thereof. The second protrusion may be engaged with the first protrusion in the hollow portion of the first ground portion.

One aspect of the present disclosure provides a board mating connector including signal contact unit, a first ground portion including a hollow portion formed thereinside to accommodate at least a portion of the signal contact unit, a second ground portion including a hollow portion formed thereinside to accommodate at least a portion of the signal contact unit and at least a portion of the first ground portion, and an elastic member disposed between the first ground portion and the second ground portion to provide an elastic restoring force in a first direction. The first ground portion of the board mating connector may include a first protrusion protruding outward or inward from a lower end portion thereof, and the second ground portion of the board mating connector may include a second protrusion protruding from an upper end portion thereof in a direction different from that of the first protrusion. The first protrusion may be engaged with the second protrusion in the hollow portion of the second ground portion.

A width of the first protrusion in the first direction may be greater than a width of the second protrusion in a second direction orthogonal to the first direction.

A width of the second protrusion in the first direction may be greater than the width of the second protrusion in the second direction.

The first ground portion may include a third protrusion and a fourth protrusion which protrude outward from an upper end portion thereof. The fourth protrusion may be formed under the third protrusion, a width of the fourth protrusion in the second direction may be smaller than a width of the third protrusion in the second direction, and a corner of the fourth protrusion may be formed to be round.

The elastic member may be formed to be moved between a first position and a second position on the first ground portion along the round corner of the fourth protrusion so that the elastic member may be prevented from deviating from a space between the first ground portion and the second ground portion. The first position on the first ground portion may be a position at which the elastic member is in contact with a lower surface of the third protrusion, and the second position on the first ground portion may be a position at which the elastic member is in contact with a lower surface of the fourth protrusion.

The board mating connector may further include a first dielectric positioned between the signal contact unit and the second ground portion. The first dielectric may have a plurality of holes passing therethrough in the first direction, and the plurality of holes of the first dielectric may be arranged with axial symmetry.

The first dielectric may be made of a heat-resistant material.

The first dielectric may include at least one selected from among polytetrafluoroethylene (PTFE), a liquid crystal polymer (LCP), polyetheretherketone (PEEK), and polyetherimide (Ultem).

The board mating connector may further include a second dielectric positioned between the signal contact unit and the first ground portion. The second dielectric may have a plurality of holes passing therethrough in the first direction, and the plurality of holes of the second dielectric may be arranged with axial symmetry.

The board mating connector may further include a housing which is attached to the second ground portion or extends from the second ground portion to accommodate at least a portion of the elastic member.

When the housing is attached to the second ground portion, the housing may be made of a nonconductive material.

Advantageous Effects

According to various exemplary embodiments of the present disclosure, it is possible to prevent the separation of a first ground portion from a second ground portion. In addition, it is possible to prevent an elastic member from deviating from the original position thereof. Furthermore, it is possible to prevent deformation of a dielectric caused by heat, thereby preventing the impedance of a connector from being changed unintentionally.

The effects of the present disclosure are not limited to the effects described above, and other effects not described above will be obvious to the persons having ordinary knowledge in this field from the following descriptions.

BRIEF DESCRIPTION OF DRAWINGS

Exemplary embodiments of the present disclosure will be described with reference to the accompanying drawings described below, and similar reference numerals denote similar elements, but the present disclosure is not limited thereto.

DETAILED DESCRIPTION

Figure 1:
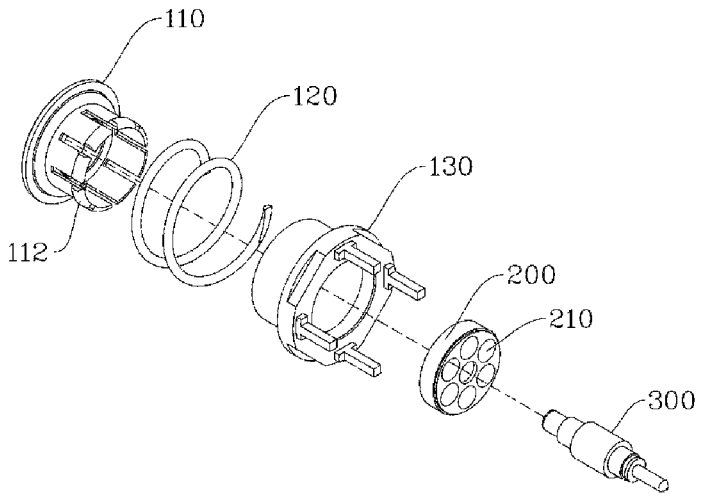
FIG. 1 is an exploded perspective view illustrating a configuration of a connector according to one exemplary embodiment of the present disclosure.

Hereinafter, specific exemplary embodiments of the present disclosure will be described in detail with reference to the accompanying drawings. In the following description, however, detailed descriptions of well-known functions and components will be omitted to avoid unnecessarily obscuring the essence of the present disclosure.

Prior to describing the exemplary embodiments of the present disclosure in detail, an upper side of the drawing may be referred to as an "upper portion" or "upper side" of a component shown in the drawing, and a lower side thereof may be referred to as a "lower portion" or "lower side." In addition, a portion between an upper portion and a lower portion of a component shown in the drawing or the remaining portion except for the upper portion and the lower portion may be referred to as a "side portion" or "side surface." Further, a vertical direction may refer to an operating direction or a first direction, and a horizontal direction may refer to a direction orthogonal to the operating direction or a second direction.

In the accompanying drawings, like or relevant components are indicated by like reference numerals. In addition, in the following description of the exemplary embodiments, repeated descriptions of the like or equivalent components will be omitted. However, even when a description of a component is omitted, such a component is not intended to be excluded in an exemplary embodiment. The relative terms such as the terms "upper portion" and "upper side" may be used to describe a relationship between components shown in the drawings, and the present disclosure is not limited to the terms.

FIG. 1 is an exploded perspective view illustrating a configuration of a connector according to one exemplary embodiment of the present disclosure. The connector may include a first ground portion 110, an elastic member 120, a second ground portion 130, a first dielectric 200, and a signal contact unit 300. The first ground portion 110 of the connector may include a hollow portion formed thereinside to accommodate at least a portion of the signal contact unit 300, and the second ground portion 130 may also include a hollow portion formed thereinside to accommodate at least a portion of the signal contact unit 300 and at least a portion of the first ground portion 110. According to one exemplary embodiment, the first ground portion 110 may be inserted into and accommodated in the hollow portion formed inside the second ground portion 130. The first ground portion 110 and the second ground portion 130 may be made of a metal.

The first ground portion 110 may include first protrusions 112 so as to be coupled to the second ground portion 130. As shown in FIG. 1, the first protrusion 112 may protrude outward from a lower end portion of the first ground portion 110. In one exemplary embodiment, the first ground portion 110 may have a plurality of incised grooves extending in a vertical direction (first direction) so as to be easily inserted into and accommodated in the second ground portion 130. In this case, a plurality of first protrusions 112 may be formed along a circumference of the lower end portion of the first ground portion 110. Since the plurality of incised grooves are formed in the first ground portion 110, the first ground portion 110 may be inserted into and accommodated in the second ground portion 130 without being damaged or deformed.

The second ground portion 130 may include second protrusions (not shown) that may be engaged with the first protrusions 112 of the first ground portion 110. According to one exemplary embodiment, the second protrusions may protrude inward from an upper end portion of the second ground portion 130 to be engaged with the first protrusions 112. Accordingly, when the first ground portion 110 is inserted into and accommodated in the second ground portion 130, the first protrusions 112 and the second protrusions may be engaged with each other in the hollow portion of the second ground portion 130 so that the first ground portion 110 and the second ground portion 130 may be coupled.

At least a portion of the signal contact unit 300 may be inserted into the hollow portions formed inside the first ground portion 110 and the second ground portion 130. The signal contact unit 300 may come into contact with a board, such as a printed circuit board, on which signal lines are formed, thereby serving to form an electrical connection. The signal contact unit 300 may be formed by coupling a first contact unit and a second contact unit. An elastic member (not shown) may be disposed inside the signal contact unit 300, and thus, the first contact unit (or second contact unit) may be vertically moved.

The first dielectric 200 may be positioned between the first and/or second ground portions 110 and 130 and the signal contact unit 300. In one exemplary embodiment, the first dielectric 200 may have a central through-hole in which the signal contact unit 300 is fixed. In addition, the first dielectric 200 may have a plurality of holes 210 vertically passing therethrough. The plurality of holes 210 may be arranged with axial symmetry. For example, the plurality of holes 210 may be arranged with axial symmetry about a center of the central through-hole.

The elastic member 120 may be disposed between the first ground portion 110 and the second ground portion 130 coupled to each other to vertically provide an elastic restoring force. For example, the elastic member 120 may be a spring made of a metal. The first ground portion 110 may be moved in a downward direction and then return to the original position thereof by the elastic restoring force of the elastic member 120. The connector is illustrated in FIG. 1 as having a cylindrical shape, but the present disclosure is not limited thereto. The connector may have one of various shapes such as a rectangular column shape, a hexagonal column shape, and an octagonal column shape.

Figure 2:
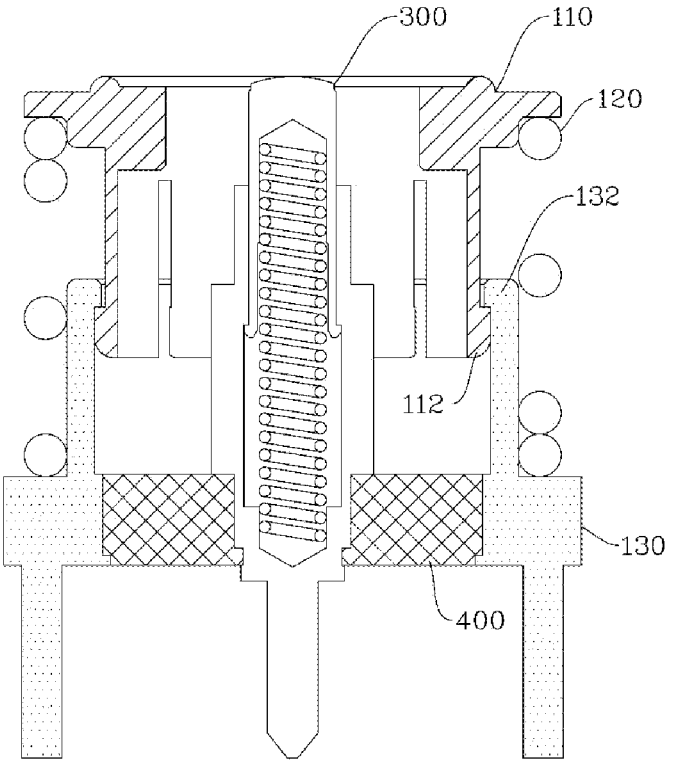
FIG. 2 is a vertical cross-sectional view of a connector according to one exemplary embodiment of the present disclosure.

FIG. 2 is a vertical cross-sectional view of a connector according to one exemplary embodiment of the present disclosure. As described above, a first ground portion 110 may include a hollow portion formed thereinside to accommodate at least a portion of a signal contact unit 300, and a second ground portion 130 may also include a hollow portion formed thereinside to accommodate at least a portion of the signal contact unit 300 and at least a portion of the first ground portion 110.

According to one exemplary embodiment, in order for the first ground portion 110 to be inserted into and accommodated in the hollow portion formed inside the second ground portion 130, a diameter of the hollow portion formed inside the first ground portion 110 may be smaller than a diameter of the hollow portion formed inside the second ground portion 130. The first ground portion 110 may include first protrusions 112 protruding outward from a lower end portion thereof. Here, a plurality of first protrusions 112 may also be formed along a circumference of the lower end portion of the first ground portion 110.

The second ground portion 130 may include second protrusions 132 protruding inward from an upper end portion thereof. Accordingly, when the first ground portion 110 is inserted into and accommodated in the second ground portion 130, the first protrusions 112 and the second protrusions 132 may be engaged with each other in the hollow portion of the second ground portion 130 so that the first ground portion 110 and the second ground portion 130 may be coupled.

An elastic member 120 may be disposed between the first ground portion 110 and the second ground portion 130 to vertically provide an elastic restoring force. According to one exemplary embodiment, one end of the elastic member 120 may be coupled to be in contact with the first ground portion 110, and the other end thereof may be coupled to be in contact with the second ground portion 130. Thus, the elastic member 120 may be compressed due to movement of the first ground portion 110 to provide an elastic restoring force. For example, when the first ground portion 110 is moved in a downward direction by a downward force that is externally applied thereto, the elastic member 120 is compressed due to the movement of the first ground portion 110. In this case, the signal contact unit 300 is also compressed in the downward direction by the downward force that is externally applied.

When an external force disappears, the first ground portion 110 returns to the original position thereof by the elastic restoring force of the elastic member 120. In this case, the first ground portion 110 is moved in an upward direction up to a position at which the first protrusions 112 are engaged with the second protrusions 132. That is, a coupling structure of the first protrusion 112 and the second protrusion 132 serves to prevent separation of the first ground portion 110 from the second ground portion 130.

A dielectric 400 may be positioned between the signal contact unit 300 and the second ground portion 130 and may have a central through-hole in which the signal contact unit 300 is fixed. In one exemplary embodiment, a material of the dielectric 400 may include a heat-resistant material. For example, the material of the dielectric 400 may include at least one selected from among polytetrafluoroethylene (PTFE), a liquid crystal polymer (LCP), polyetheretherketone (PEEK), and polyetherimide (Ultem). Since the material of the dielectric 400 includes the heat-resistant material, when the second ground portion 130 is inserted into and fixed in a circuit board, even when a heat applying process such as surface mounter technology (SMT) is performed, the performance and durability of a product can be prevented from being degraded due to a change in the position and shape of the signal contact unit 300 which is fixed by the dielectric 400. In addition, the impedance of the connector can be prevented from being changed unintentionally.

Figure 3:
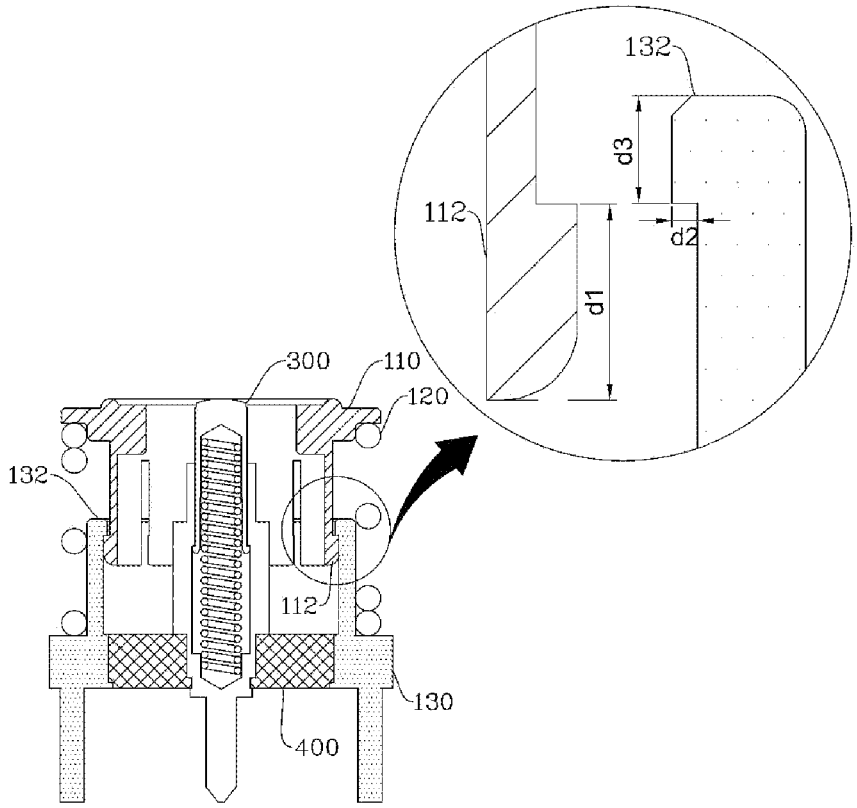
FIG. 3 is an enlarged cross-sectional view of a first protrusion and a second protrusion according to one exemplary embodiment of the present disclosure.

FIG. 3 is an enlarged cross-sectional view of the first protrusion 112 and the second protrusion 132 according to one exemplary embodiment of the present disclosure. For convenience of understanding, in the enlarged cross-sectional view, the first protrusion 112 and the second protrusion 132 are illustrated as being spaced apart from each other. Due to an engagement structure of the first protrusion 112 formed at the lower end portion of the first ground portion 110 and the second protrusion formed at the upper end portion of the second ground portion 130, the first ground portion 110 can be prevented from being separated from the second ground portion 130.

However, when a force having a certain magnitude or more is applied in a direction (horizontal direction or second direction) orthogonal to an operating direction (vertical direction) of the first ground portion 110, in spite of the engagement structure of the first protrusion 112 and the second protrusion 132, the first ground portion 110 may be separated from the second ground portion 130 and thus may not operate. In order to solve such a problem, there is a method of extending a horizontal width of the first protrusion 112 and a horizontal width of the second protrusion 132. However, in this case, it may be difficult to assemble the first ground portion 110 and the second ground portion 130, and in a process of assembling the first ground portion 110 and the second ground portion 130, there may be another problem in that the first ground portion 110 is deformed or the second ground portion 130 is damaged.

The present disclosure is directed to solving the problem by forming a vertical width d1 of the first protrusion 112 to be greater than a horizontal width d2 of the second protrusion 132. Since the vertical width d1 of the first protrusion 112 is formed to be greater than the horizontal width d2 of the second protrusion 132, when a horizontal force is applied to the first ground portion 110 or a force is asymmetrically applied to the first ground portion 110 in a downward direction, even when the first protrusion 112 deviates from a coupling position with the second protrusion 132, a vertical portion (portion d1) of the first protrusion 112 may be placed on a vertical portion (portion d3) of the second protrusion 132 and then return to the original position thereof again, thereby preventing a separation phenomenon of the first ground portion 110. In this case, since a horizontal width of the first protrusion 112 and the horizontal width d2 of the second protrusion 132 are not formed to extend, the first ground portion 110 and the second ground portion 130 can also be easily assembled.

Additionally, since a vertical width d3 of the second protrusion 132 is formed to be greater than the horizontal width d2 of the second protrusion 132, when a force is applied to the first ground portion 110 in a direction (horizontal direction) orthogonal to an operating direction (vertical direction) thereof or a force is asymmetrically applied to the first ground portion 110 in a downward direction, the vertical portion (portion d1) of the first protrusion 112 may be sufficiently supported on the vertical portion (portion d3) of the second protrusion 132, thereby preventing the first ground portion 110 from being separated from the second ground portion 130. For example, the vertical width d1 of the first protrusion 112 and the vertical width d3 of the second protrusion 132 may be formed to have a similar or the same length.

Figure 4:
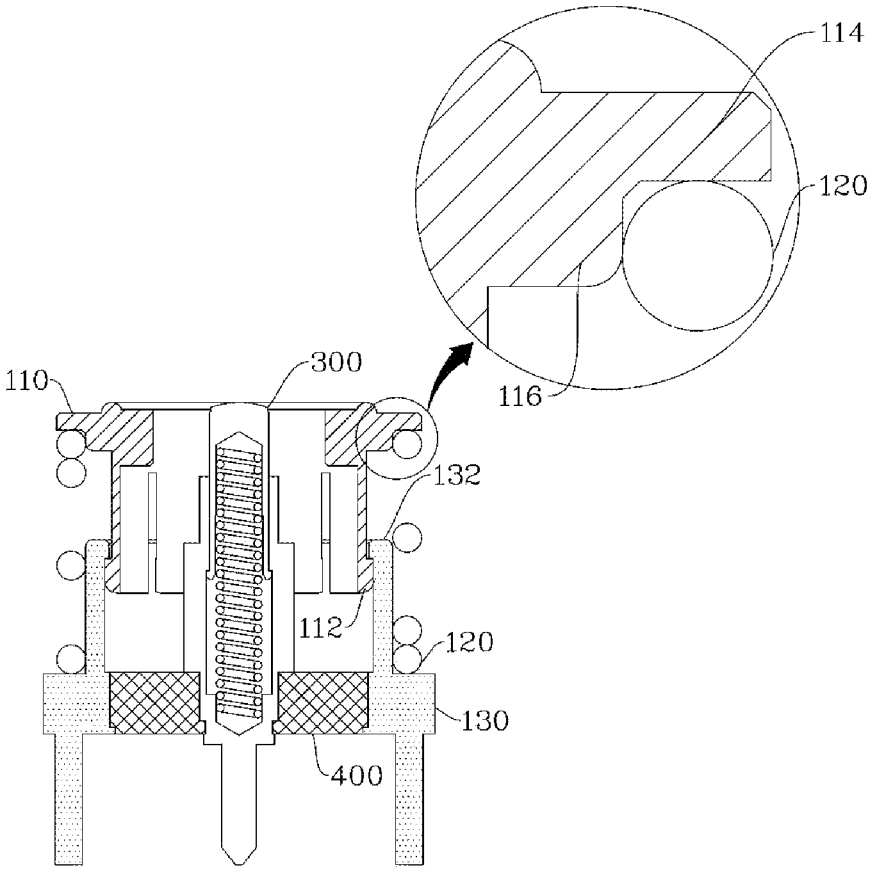
FIG. 4 is an enlarged cross-sectional view of a portion at which a first ground portion and an elastic member are in contact with each other according to one exemplary embodiment of the present disclosure.

FIG. 4 is an enlarged cross-sectional view of a portion at which the first ground portion 110 and the elastic member 120 are in contact with each other according to one exemplary embodiment of the present disclosure. According to one exemplary embodiment, the first ground portion 110 may include a third protrusion 114 and a fourth protrusion 116 which protrude outward from an upper end portion thereof. Here, the fourth protrusion 116 may be formed under the third protrusion 114, and a horizontal width of the fourth protrusion 116 may be smaller than a horizontal width of the third protrusion 114.

According to one exemplary embodiment, as shown in FIG. 4, the elastic member 120 may be disposed to be in contact with a lower surface of the third protrusion 114 and a side surface of the fourth protrusion 116. In this case, a corner of the fourth protrusion 116 may be formed to be round so that the elastic member 120 may be moved between a first position and a second position on the first ground portion 110 along the corner of the fourth protrusion 116. Here, the first position on the first ground portion 110 may be a position at which the elastic member 120 is in contact with the lower surface of the third protrusion 114 and the side surface of the fourth protrusion 116. The second position on the first ground portion 110 may be a position at which the elastic member 120 is in contact with the lower surface of the fourth protrusion 116.

When a force is applied to the first ground portion 110 in a direction (horizontal direction) orthogonal to an operating direction (vertical direction) thereof or a force is asymmetrically applied to the first ground portion 110 in a downward direction, and thus, when the first ground portion 110 is biased in the horizontal direction and moved in the downward direction, the elastic member 120 may deviate outward from the first position to be separated from the first ground portion 110 and the second ground portion 130. In this case, as shown in FIG. 4, since the corner of the fourth protrusion 116 is formed to be round, when the first ground portion 110 is biased in the horizontal direction and moved in the downward direction, the elastic member 120 is moved to the second position instead of deviating outward from the first position. In this case, the elastic member 120 may be further compressed by a difference between an interval from the first position to the second ground portion 130 and an interval from the second position to the second ground portion 130, and thus, the elastic member 120 may return to the original position thereof, i.e., the first position along the rounded corner of the fourth protrusion 116 by the increased elastic restoring force of the elastic member 120. Therefore, it is possible to prevent the elastic member 120 from being separated from the first ground portion 110 and the second ground portion 130.

Figure 5:
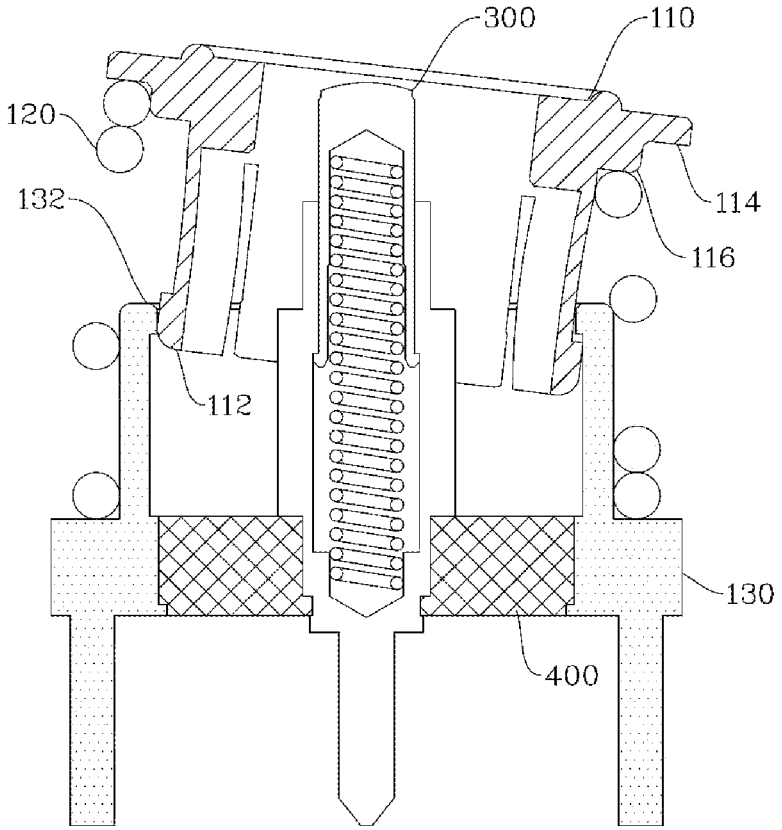
FIG. 5 is a vertical cross-sectional view illustrating that the first ground portion of the connector according to one exemplary embodiment of the present disclosure is biased in a horizontal direction and moved in a downward direction

FIG. 5 is a vertical cross-sectional view illustrating that the first ground portion 110 of the connector according to one exemplary embodiment of the present disclosure is biased in a horizontal direction and moved in a downward direction. As described above, when a force is applied to the first ground portion 110 in a direction (horizontal direction) orthogonal to an operating direction (vertical direction) thereof or a force is applied asymmetrically to the first ground portion 110 in a downward direction, the first ground portion 110 may be biased in the horizontal direction and moved in the downward direction. For example, as shown in FIG. 5, when a force is applied to only a right portion of the first ground portion 110 in the downward direction, only the right portion to which the force is applied may be moved in the downward direction. A left portion of the first ground portion 110, which is opposite to the right portion, may deviate from the original position thereof to be moved in an upward direction.

When the right portion of the first ground portion 110 is moved in the downward direction, as shown in FIG. 5, a right portion of the elastic member 120 may deviate from the original position thereof, i.e., the first position and may be moved to the second position. As a result, the right portion of the elastic member 120 may be further compressed by a height difference between the first position and the second position, and thus, the increased elastic restoring force of the elastic member 120 may be provided to right portions of the first ground portion 110 and the second ground portion 130. Accordingly, the elastic member 120 may return to the first position, which is the original position thereof, along the rounded corner of the fourth protrusion 116.

Meanwhile, when a left side of the first ground portion 110 is moved in an upward direction, as shown in FIG. 5, the first protrusion 112 may deviate from a coupling position with the second protrusion 132 and may be placed on the vertical portion (portion d3 of FIG. 3) of the second protrusion 132. In this case, since the vertical width (see d1 of FIG. 3) of the first protrusion 112 is formed to be greater than the horizontal width (see d2 of FIG. 3) of the second protrusion 132 and the vertical width (see d3 of FIG. 3) of the second protrusion 132 is formed to be greater than the horizontal width (see d2 of FIG. 3) of the second protrusion 132, the first ground portion 110 may not be completely separated from the second ground portion 130 and may maintain a state of being placed on the vertical portion (portion d3 of FIG. 3) of the second protrusion 132. In a state in which the first protrusion 112 is placed on the vertical portion (portion d3 in FIG. 3) of the second protrusion 132, when the left side of the first protrusion 112 is moved in the downward direction by an external force or an elastic restoring force provided by the elastic member 120, the first protrusion 112 may return to the coupling position with the second protrusion 132.

Figure 6:
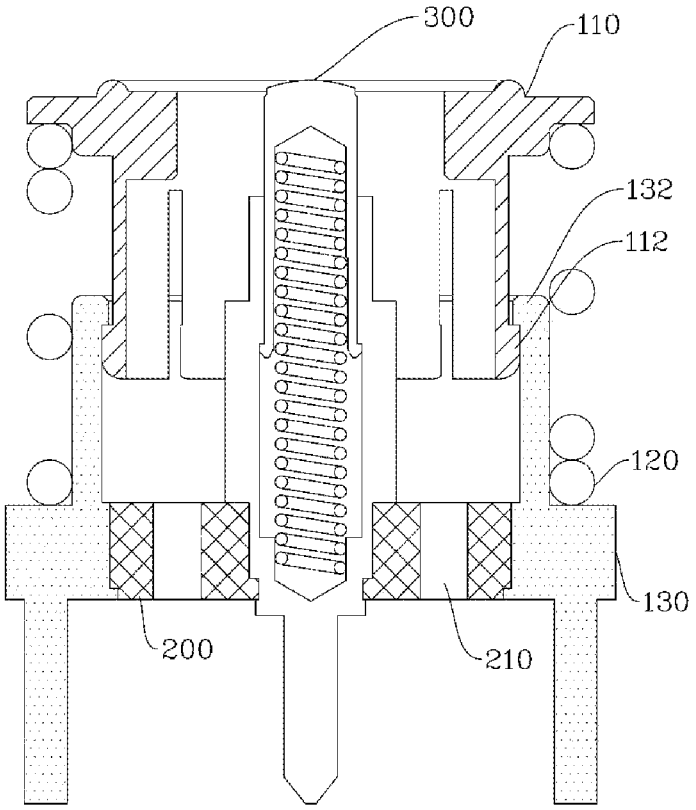
FIG. 6 is a vertical cross-sectional view of a connector according to one exemplary embodiment of the present disclosure.

FIG. 6 is a vertical cross-sectional view of a connector according to one exemplary embodiment of the present disclosure. A first dielectric 200 may be positioned between a second ground portion 130 and a signal contact unit 300. In one exemplary embodiment, the first dielectric 200 may have a central through-hole in which the signal contact unit 300 is fixed. In addition, the first dielectric 200 may have a plurality of holes 210 vertically passing therethrough. The plurality of holes 210 may be arranged with axial symmetry. For example, the plurality of holes 210 may be arranged with axial symmetry about a center of the central through-hole.

Since the plurality of holes 210 are formed in the first dielectric 200, when the second ground portion 130 is inserted into and fixed in a circuit board and when a heat applying process such as SMT is performed, heat may be discharged through the plurality of holes 210. Accordingly, it is possible to prevent heat from accumulating in the first dielectric 200 to prevent a change in impedance due to deformation of the first dielectric 200. In addition, the performance and durability of a product can be prevented from being degraded due to a change in the position and shape of the signal contact unit 300 which is fixed by the first dielectric 200. Furthermore, the plurality of holes 210 are arranged with axial symmetry, thereby providing a uniform dielectric constant.

In one exemplary embodiment, the first dielectric 200 may be made of a heat-resistant material. For example, the first dielectric 200 may include at least one selected from among PTFE, an LCP, PEEK, and Ultem. Since the first dielectric 200 is made of the heat-resistant material, even when a heat applying process such as SMT is performed when the second ground portion 130 is inserted into and fixed in a circuit board, the performance and durability of a product can be prevent from being degraded due to a change in the position and shape of the signal contact unit 300, which is fixed by the first dielectric 200. In addition, the impedance of the connector can be prevented from being changed unintentionally.

The first dielectric 200 is illustrated in FIG. 6 as being positioned between the second ground portion 130 and the signal contact unit 300, but the present disclosure is not limited thereto. The first dielectric 200 may also be disposed between a first ground portion 110 and the signal contact unit 300.

Figure 7:
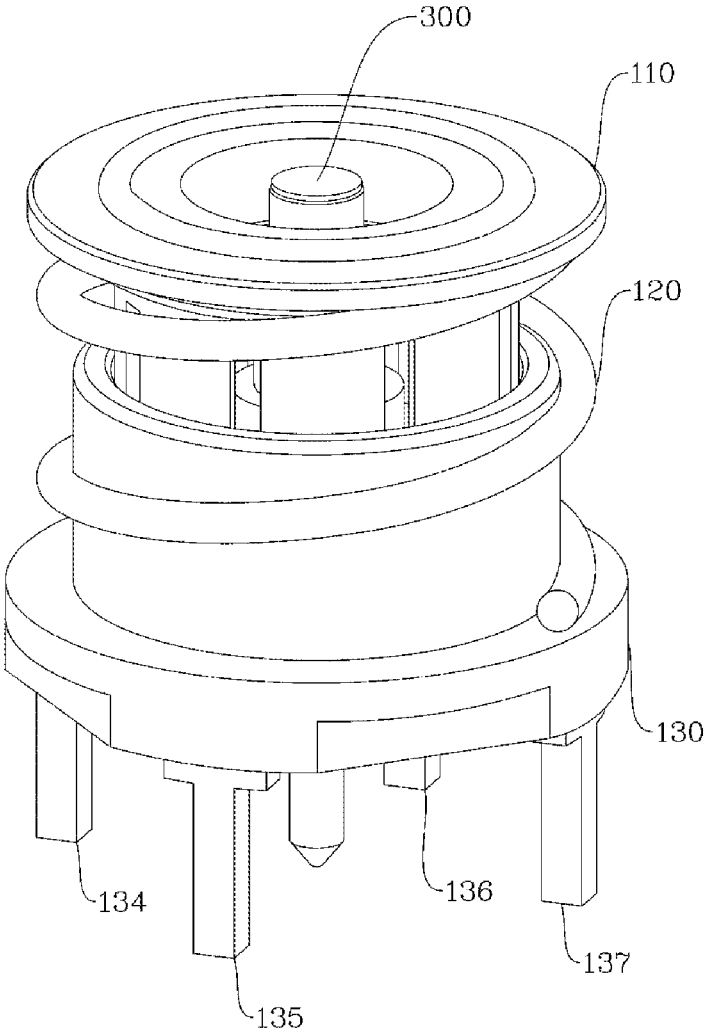
FIG. 7 is a perspective view illustrating an overall configuration of the connector according to one exemplary embodiment of the present disclosure.

FIG. 7 is a perspective view illustrating an overall configuration of the connector according to one exemplary embodiment of the present disclosure. As described above, the first ground portion 110 may be inserted into and accommodated in the second ground portion 130, and the elastic member 120 may be disposed between the first ground portion 110 and the second ground portion 130. The signal contact unit 300 may be disposed in the hollow portions of the first ground portion 110 and the second ground portion 130, and the dielectric may be disposed between the first and/or second ground portions 110 and 130 and the signal contact unit 300.

According to one exemplary embodiment, the second ground portion 130 may include a plurality of ground pins 134, 135, 136, and 137. For example, the plurality of ground pins 134, 135, 136, and 137 may be formed at a lower end of the second ground portion 130. The plurality of ground pins 134, 135, 136, and 137 may be inserted into holes formed in a printed circuit board or the like and then may be fixed through soldering, SMT, or the like.

Figure 8:
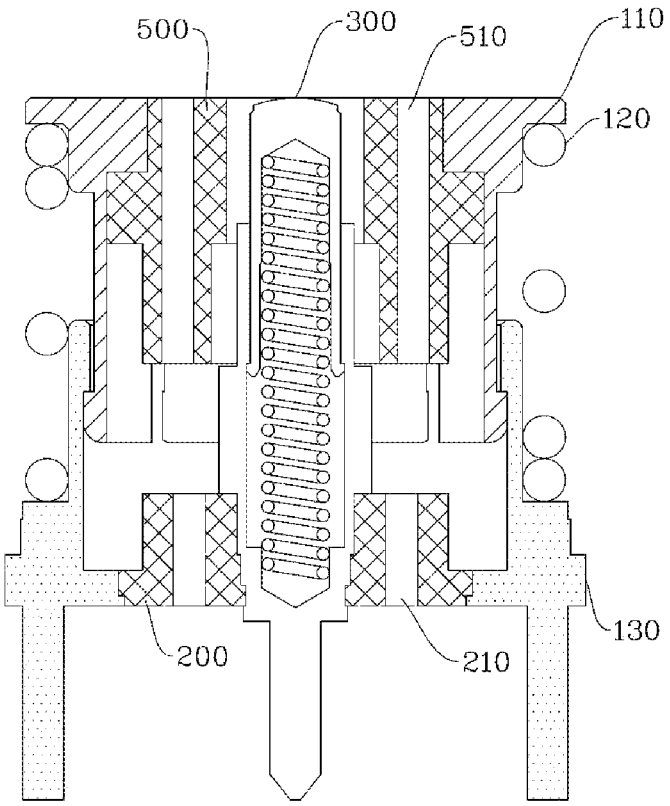
FIG. 8 is a vertical cross-sectional view of a connector according to one exemplary embodiment of the present disclosure.

FIG. 8 is a vertical cross-sectional view of a connector according to one exemplary embodiment of the present disclosure. In one exemplary embodiment, the connector may include a first dielectric 200 positioned between a second ground portion 130 and a signal contact unit 300 and a second dielectric 500 positioned between a first ground portion 110 and the signal contact unit 300. In one exemplary embodiment, the first dielectric 200 and the second dielectric 500 may each have a central through-hole in which the signal contact unit 300 is fixed. In addition, the first dielectric 200 and the second dielectric 500 may each have a plurality of holes 210 and 510 vertically passing therethrough. The plurality of holes 210 and 510 may be arranged with axial symmetry. For example, the plurality of holes 210 and 510 may each be arranged with axial symmetry about centers of the central through-holes.

In one exemplary embodiment, the second dielectric 500 may be made of a heat-resistant material. For example, the second dielectric 500 may include at least one selected from among PTFE, an LCP, PEEK, and Ultem.

Figure 9:
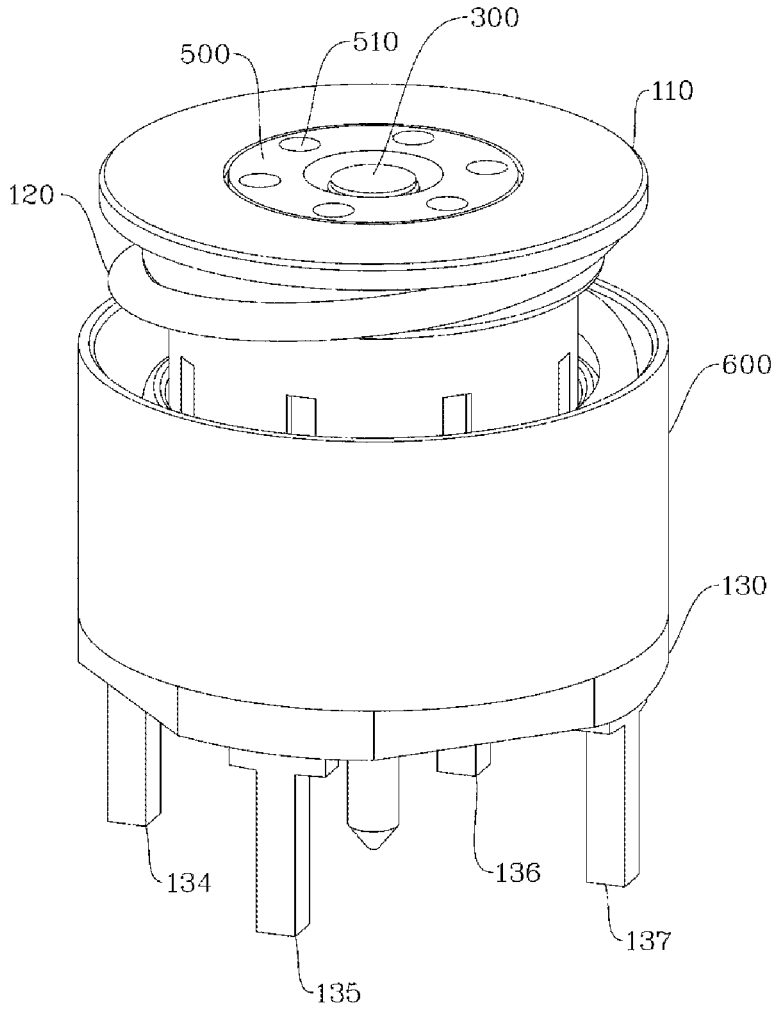
FIG. 9 is a perspective view illustrating an overall configuration of the connector according to one exemplary embodiment of the present disclosure.

FIG. 9 is a perspective view illustrating an overall configuration of the connector according to one exemplary embodiment of the present disclosure. The connector may include a housing 600 which is attached to the second ground portion 130 or extends from the second ground portion 130 to accommodate at least a portion of the elastic member 120. When a strong force is externally applied, the elastic member 120 may deviate from the original position thereof. In this case, the housing 600 accommodating at least a portion of the elastic member 120 may be disposed to prevent the positional displacement of the elastic member 120.

When the housing 600 is manufactured in a form attached to the second ground portion 130, the housing 600 may be manufactured separately from the second ground portion 130. Thus, the second ground portion 130 may be more simply processed during manufacturing thereof. In addition, the housing 600 may be made of a nonconductive material, thereby reducing manufacturing costs thereof. For example, the housing 600 may be made of a plastic material.

Figure 10:
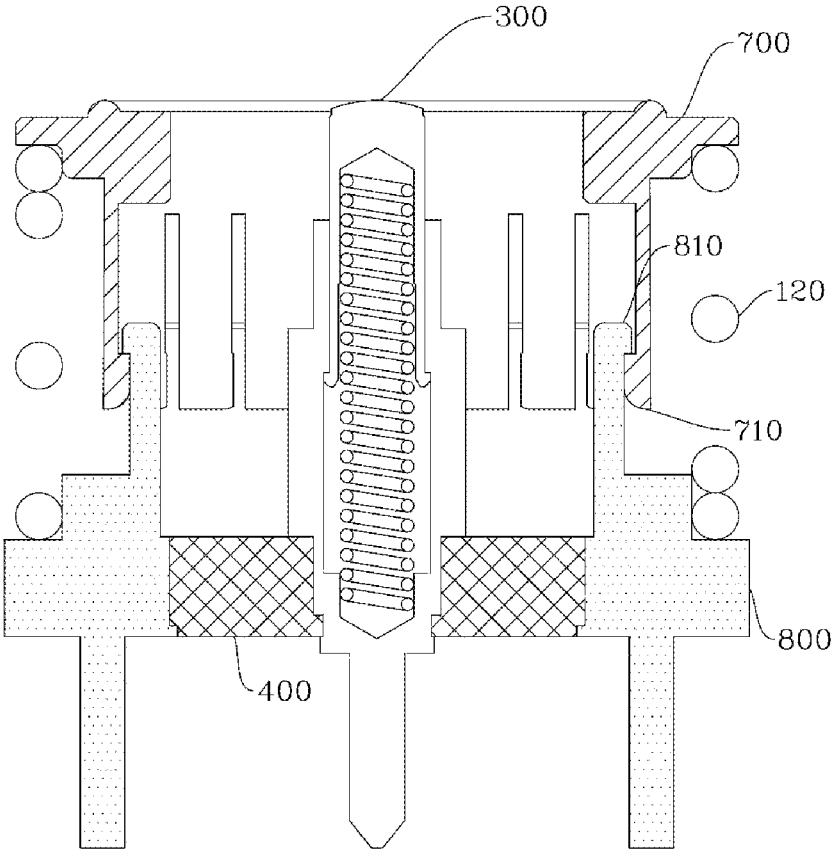
FIG. 10 is a vertical cross-sectional view of a connector according to one exemplary embodiment of the present disclosure.

FIG. 10 is a vertical cross-sectional view of a connector according to one exemplary embodiment of the present disclosure. According to the present exemplary embodiment, at least a portion of a second ground portion 800 may be inserted into a hollow portion formed inside a first ground portion 700. In this case, a diameter of the hollow portion formed inside the first ground portion 700 may be formed to be greater than a diameter of a hollow portion formed inside second ground portion 800 to accommodate the second ground portion 800.

The first ground portion 700 may include first protrusions 710 protruding inward from a lower end portion thereof. Here, a plurality of first protrusions 710 may be formed along a circumference of the lower end portion of the first ground portion 700. Due to incised grooves between the plurality of first protrusions 710, when the second ground portion 800 is inserted into the first ground portion 700, a circumference of an outer circumferential surface of the first ground portion 700 may be adjusted to match with an outer diameter of the second ground portion 800. Therefore, the second ground portion 800 may be suitably inserted into and accommodated in the hollow portion of the first ground portion 700.

The second ground portion 800 may include second protrusions 810 protruding outward from an upper end portion thereof so as to be engaged with the first protrusions 710. Accordingly, when the second ground portion 800 is inserted into and accommodated in the first ground portion 700, the first protrusions 710 and the second protrusions 810 may be engaged with each other in the hollow portion of the first ground portion 700 so that the first ground portion 700 and the second ground portion 800 may be coupled.

In the first protrusion and the second protrusion described above, as shown in FIG. 2, the first protrusion 112 may protrude outward from the lower end portion of the first ground portion 110, and the second protrusion 132 may protrude inward from the upper end portion of the second ground portion 130 so as to be engaged with the first protrusion 112.

In addition, as shown in FIG. 10, the first protrusion 710 may protrude inward from the lower end portion of the first ground portion 700, and the second protrusion 810 may protrude outward from the upper end of the second ground portion 800 so as to be engaged with the first protrusion 710.

As described above, the first protrusion may protrude outward or inward from the lower end portion of the first ground portion, and the second protrusion may protrude in a different direction from the first protrusion so as to be engaged with the first protrusion.

An elastic member 120 may be disposed between the first ground portion 700 and the second ground portion 800. The hollow portion for accommodating at least a portion of a signal contact unit 300 may be formed inside the first ground portion 700, and a hollow portion for accommodating at least a portion of the signal contact unit 300 may be formed inside the second ground portion 800. A dielectric 400 is illustrated in FIG. 10 as being disposed between the second ground portion 800 and the signal contact unit 300, but the present disclosure is not limited thereto. The dielectric 400 may also be disposed between the first ground portion 700 and the signal contact unit 300. In addition, a plurality of holes may be arranged with axial symmetry in the dielectric 400.

Exemplary embodiments of the present disclosure are disclosed for exemplary purposes, and those skilled in the art should appreciate that various changes, modifications, and additions are possible without departing from the spirit and the scope of the present disclosure, and such changes, modifications, and additions should be within the scope of the claims.

Since those skilled in the art may variously replace, transform, and modify the present disclosure without departing from the spirit of the present disclosure, the present disclosure is not limited by the above-described exemplary embodiments and the accompanying drawings.

DESCRIPTION OF REFERENCE NUMERALS

| | |
|---|---|
| 110, 700: first ground portion | 112, 710: first protrusion |
| 114: third protrusion | 116: fourth protrusion |
| 120: elastic member | 130, 800: second ground portion |
| 132, 810: second protrusion | |
| 134, 135, 136, 137: plurality of ground pins | |
| 200: first dielectric | 400: dielectric |
| 500: second dielectric | 210, 510: plurality of holes |
| 300: signal contact unit | 600: housing |

We claim:

1. A connector that is a board mating connector, comprising:

a signal contact unit;

a first ground portion including a hollow portion formed thereinside to accommodate at least a portion of the signal contact unit;

a second ground portion including a hollow portion formed thereinside to accommodate at least a portion of the signal contact unit and at least a portion of the first ground portion; and an elastic member disposed between the first ground portion and the second ground portion to provide an elastic restoring force in a first direction, wherein:

the first ground portion includes a first protrusion protruding outward from a lower end portion thereof, the second ground portion includes a second protrusion protruding from an upper end portion thereof in a direction different from that of the first protrusion, the first protrusion is engaged with the second protrusion in the hollow portion of the second ground portion, the first protrusion and the second protrusion are disposed within a radius of an extension length of the elastic member so as to be disposed inside the elastic member, a width of the first protrusion in the first direction is greater than a width of the second protrusion in the first direction, the width of the first protrusion in the first direction is greater than a width of the second protrusion in a second direction orthogonal to the first direction, the first ground portion further includes a third protrusion and a fourth protrusion which protrude outward from an upper end portion thereof, the fourth protrusion is formed under the third protrusion, a width of the fourth protrusion in the second direction is smaller than a width of the third protrusion in the second direction, and a corner of the fourth protrusion is formed to be round.

2. The connector of claim 1, wherein the width of the second protrusion in the first direction is greater than the width of the second protrusion in the second direction.

3. The connector of claim 1, wherein the elastic member is formed to be moved between a first position and a second position on the first ground portion along the round corner of the fourth protrusion so that the elastic member is prevented from deviating from a space between the first ground portion and the second ground portion, the first position on the first ground portion is a position at which the elastic member is in contact with a lower surface of the third protrusion, and the second position on the first ground portion is a position at which the elastic member is in contact with a lower surface of the fourth protrusion.

4. The connector of claim 1, further comprising a first dielectric positioned between the signal contact unit and the second ground portion, wherein the first dielectric has a plurality of holes passing therethrough in the first direction, and the plurality of holes of the first dielectric are arranged with axial symmetry.

5. The connector of claim 4, wherein the first dielectric is made of a heat-resistant material.

6. The connector of claim 5, wherein the first dielectric includes at least one selected from among polytetrafluoroethylene, a liquid crystal polymer, polyetheretherketone, and polyetherimide.

7. The connector of claim 4, further comprising a second dielectric positioned between the signal contact unit and the first ground portion, wherein the second dielectric has a plurality of holes passing therethrough in the first direction, and the plurality of holes of the second dielectric are arranged with axial symmetry.

8. The connector of claim 1, further comprising a housing which is attached to the second ground portion or extends from the second ground portion to accommodate at least a portion of the elastic member.

9. The connector of claim 8, wherein, when the housing is attached to the second ground portion, the housing is made of a nonconductive material.

10. A connector that is a board mating connector, comprising:

a signal contact unit;

a first ground portion including a hollow portion formed thereinside to accommodate at least a portion of the signal contact unit and at least a portion of a second ground portion;

the second ground portion including a hollow portion formed thereinside to accommodate at least a portion of the signal contact unit; and an elastic member disposed between the first ground portion and the second ground portion to provide an elastic restoring force in a first direction, wherein:

the first ground portion includes a first protrusion protruding inward from a lower end portion thereof, the second ground portion includes a second protrusion protruding from an upper end portion thereof in a direction different from that of the first protrusion, the first protrusion is engaged with the second protrusion in the hollow portion of the first ground portion, the first protrusion and the second protrusion are disposed within a radius of an extension length of the elastic member so as to be disposed inside the elastic member, a width of the first protrusion in the first direction is greater than a width of the second protrusion in the first direction, the width of the first protrusion in the first direction is greater than a width of the second protrusion in a second direction orthogonal to the first direction, the first ground portion further includes a third protrusion and a fourth protrusion which protrude outward from an upper end portion thereof, the fourth protrusion is formed under the third protrusion, a width of the fourth protrusion in the second direction is smaller than a width of the third protrusion in the second direction, and a corner of the fourth protrusion is formed to be round.

* * * * *